US006651846B2

(12) United States Patent
Duquet et al.

(10) Patent No.: US 6,651,846 B2
(45) Date of Patent: Nov. 25, 2003

(54) FLUID DISPENSER ASSEMBLY

(75) Inventors: Frédéric Duquet, Thibouville (FR); Firmin Garcia, Evreux (FR); Hervé Pennaneac'h, Piseux (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 10/166,006

(22) Filed: Jun. 11, 2002

(65) Prior Publication Data

US 2002/0195465 A1 Dec. 26, 2002

Related U.S. Application Data

(60) Provisional application No. 60/303,084, filed on Jul. 6, 2001.

(30) Foreign Application Priority Data

Jun. 14, 2001 (FR) ..... 01 07802

(51) Int. Cl.[7] ..... B65D 35/22

(52) U.S. Cl. ..... 222/103; 222/105; 206/484; 383/209

(58) Field of Search ..... 222/103, 105; 206/484; 383/209

(56) References Cited

U.S. PATENT DOCUMENTS 2,125,318 A * 8/1938 Salfisberg ..... 222/105
4,923,063 A * 5/1990 Tararuj ..... 206/484
4,981,213 A * 1/1991 Dillon ..... 206/469
6,264,065 B1 * 7/2001 Jouillat ..... 222/94
6,478,195 B2 * 11/2002 Duquet et al. ..... 222/183
6,540,079 B1 * 4/2003 Garcia et al. ..... 206/484

FOREIGN PATENT DOCUMENTS

| | | | |
|---|---|---|---|
| EP | 0 473 190 A | 3/1992 | |
| FR | 2644141 A1 * | 9/1990 | ..... B65D/35/22 |
| FR | 2 791 645 | 10/2000 | |
| WO | WO 94/01343 | 1/1994 | |

* cited by examiner

*Primary Examiner*—Kenneth Bomberg
(74) *Attorney, Agent, or Firm*—Sughrue Mion, PLLC

(57) ABSTRACT

A fluid dispenser assembly comprising:

a fluid dispenser (1) defining a fluid reservoir (11), a deformable actuating wall (12), and an outlet orifice (13); and packaging (2) defining a casing (21, 22) surrounding the dispenser (1), the actuating wall being pushed in via the casing;

said fluid dispenser assembly being characterized in that the packaging further comprises a hinged flap (23, 24) that can be folded over onto the casing (21, 22) so as to be superposed thereon, the flap being secured to or integral with the casing via a side edge (25), the flap comprising an outside face (23) and an inside face (24) serving to come into contact with the casing when the flap is folded over on the casing.

10 Claims, 2 Drawing Sheets

FLUID DISPENSER ASSEMBLY

CROSS REFERENCE TO RELATED APPLICATION

This application claims the benefit under 35 U.S.C. §119 (e) of pending U.S. provisional patent application Ser. No. 60/303,084, filed Jul. 6, 2001, and priority under 35 U.S.C. §119(a)–(d) of French patent application No. FR-01.07802, filed Jun. 14, 2001.

BACKGROUND OF THE INVENTION

The present invention relates to a fluid dispenser assembly comprising a fluid dispenser and packaging. The fluid dispenser defines a fluid reservoir, a deformable actuating wall, and an outlet orifice. By depressing the actuating wall, it is possible to cause the volume of the reservoir to decrease, thereby causing the pressure inside the reservoir to increase, thereby causing the fluid to be delivered through the outlet orifice, e.g. in the form of a jet of sprayed fluid. In addition, the packaging defines a casing that surrounds the dispenser, optionally leaving its outlet orifice apparent, the actuating wall being pushed in via the casing. As a result, the fluid dispenser is not visible because it is masked by the casing of the packaging. The user presses on the casing, substantially on the actuating wall of the dispenser. However, the casing may be provided with a window through which a portion of the dispenser is visible.

A fluid dispenser that can be used in this type of dispenser assembly is described, for example, in Document FR 2 791 645. That document describes a dispenser that, in the initial storage state prior to be used, is very thin. This is made possible because the spring that enables the deformable actuating wall to be returned to its rest position is fully compressed. The outlet orifice is initially closed off by a removable closure element which prevents air from penetrating into the reservoir. The reservoir then contains a very tiny amount of fluid only, and the spring is fully compressed in an almost flat state.

Such a prior art dispenser is easy to dispose in a packaging casing so that it is completely encased except for its outlet orifice. It is advantageous for the casing to be provided with a notch or a pre-cut enabling the removable closure element to be removed easily to unmask the outlet orifice.

Although the casing of the dispenser already offers an acceptably large area on which to place indications, such as the trademark, the nature, and the use of the fluid, it is sometimes necessary to have a larger indication-bearing area. In addition, the casing surrounding the dispenser is not particularly aesthetically-pleasing in appearance. For a perfume, for example, it may be advantageous for the dispenser assembly to be evocative of the shape of the bottle in which the perfume is sold.

BRIEF SUMMARY OF THE INVENTION

To remedy these drawbacks of the prior art, the present invention makes provision for the packaging to further comprise a hinged flap that can be folded over onto the casing so as to be superposed thereon, the flap being secured to or integral with the casing via a side edge, the flap comprising an outside face and an inside face serving to come into contact with the casing when the flap is folded over on the casing. By adding this hinged flap that can be folded over onto the casing, it is possible to double the working indication-bearing area of the dispenser assembly, and it is possible to protect the casing particularly where it covers the deformable actuating wall of the dispenser. The dispenser assembly is then in the form of a small book which, in the closed state, presents the outside face of the hinged flap, and, in the open state, presents the inside face of the casing and the inside face of the flap. Once it is open, the user can actuate the dispenser by pressing on the casing.

Advantageously, the outside face incorporates a portion in relief defining an internal volume, said portion in relief projecting frontwards from the outside face. Thus, in the closed state, only the portion in relief of the outside face of the flap is visible, the dispenser being completely masked by the casing and by the folded-over flap. Advantageously, the portion in relief is in the form of a bottle of perfume. Thus, the user can immediately recognize the shape of the bottle in which the perfume is actually sold in the shops. As a result, the dispenser assembly of the invention lends itself particularly well to being used as a sample distributed free of charge in shops for promotional and test purposes. After the user has actuated the dispenser, the user can buy a bottle of perfume whose shape and design are already apparent on the outside of the flap at the portion in relief. Thus, the sample/dispenser assembly makes it possible firstly to become acquainted with the intrinsic characteristics of the perfume, and secondly to recognize the bottle of perfume actually sold in the shops. In short, the dispenser assembly gives a dual indication related both to the contents and to the container of the perfume. Naturally, perfume may be replaced by any other fluid, such as a lotion, a lacquer, a solvent, nail varnish remover, etc.

Although a portion in relief is preferred, it is also possible for the outside face of the flap to be provided merely with a two-dimensional graphical representation.

However, the portion in relief is preferred and it may, for example, contain a fluid. The fluid may be identical to the fluid in the dispenser, but it may also be a fluid associated with the fluid of the dispenser, or a fluid of the same product range as the fluid of the dispenser. For example, the dispenser may contain a perfume, and the portion in relief may contain a cream or a make-up.

In a characteristic of the invention, the inside face of the flap is provided with a peel-off or tear-off portion forming an opening through which to access the back of the portion in relief. Preferably, the portion in relief is part of an insert held between two sheets respectively forming the outside face and the inside face of the flap. It is thus possible to extract the insert from the flap via the inside face by removing the tear-off or peel-off portion.

In a practical embodiment, the outside face of the flap is provided with a window through which the portion in relief projects. Thus, only the portion in relief is visible through the window, and the remainder or the base of the insert is disposed and hidden between the two sheets forming the hinged flap.

Similarly, the casing is made up of two sheets between which the dispenser is disposed, the dispenser advantageously being fixed to one of the sheets. In another practical embodiment, the flap and the casing are made in one piece. The packaging may be made of a single sheet of card, of plastic, or metal or of a compound thereof.

BRIEF DESCRIPTION OF THE DRAWINGS

The invention is described below with reference to the accompanying drawings which show two embodiments of the invention by way of non-limiting example.

In the figures.

DETAILED DESCRIPTION

Figure 1:
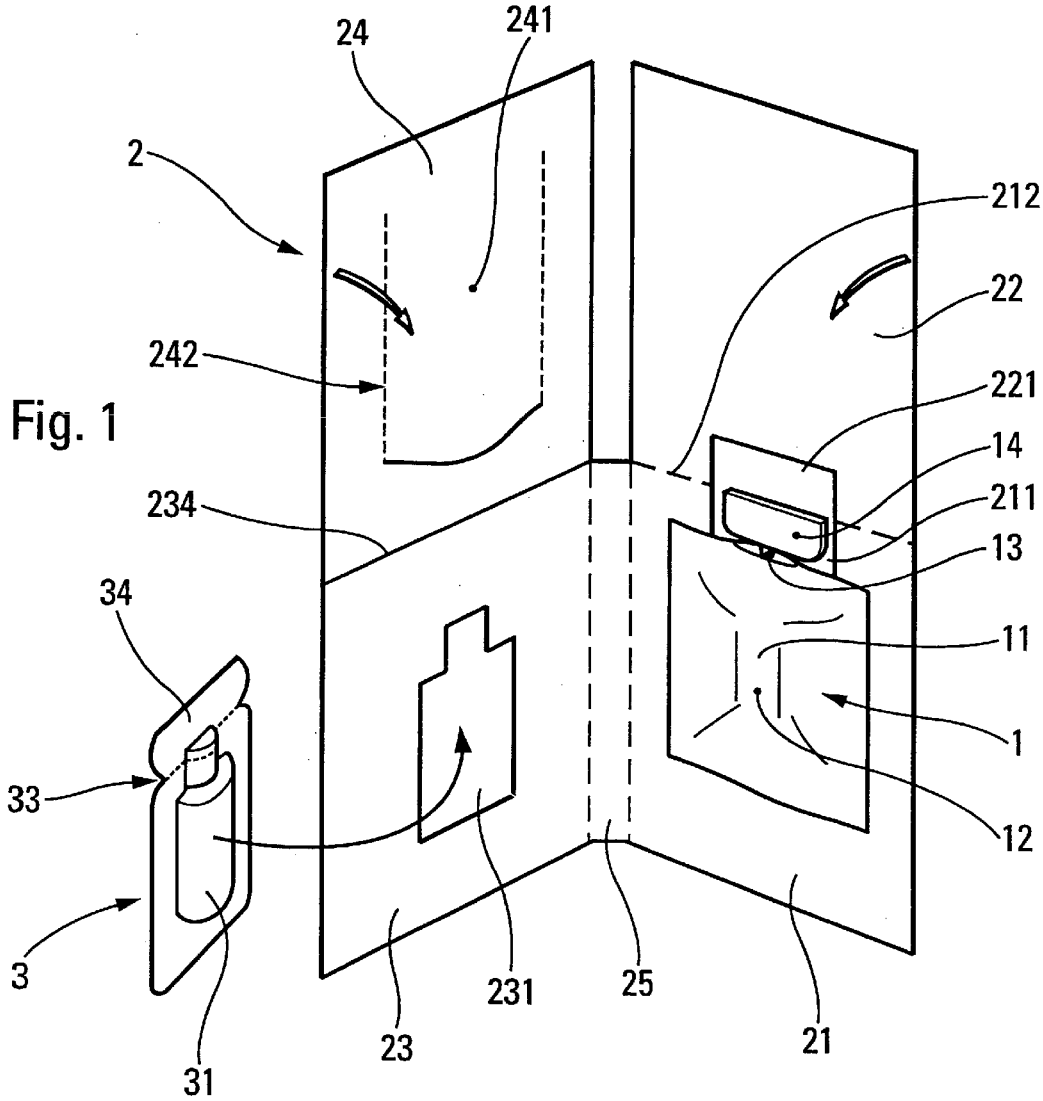
FIG. 1 is a diagrammatic perspective view of a dispenser assembly of the invention while it is being assembled.

In both of the embodiments described below, the fluid dispenser, designated by numerical reference 1, may be the same. It may be similar to or identical to the fluid dispenser described in above-mentioned Document FR 2 791 645. The dispenser 1 comprises a reservoir 11 formed by two flexible sheets bonded together over their peripheries. The reservoir 11 is provided with one or two actuating walls 12 formed on one or both of the bonded-together sheets forming the reservoir 11. The dispenser 1 also defines an outlet orifice 13 which is preferably a spray orifice. To mask the outlet orifice 13, a removable closure member 14 is provided that can be torn off or folded back in order to unmask the outlet orifice 13. It is also advantageous for the dispenser 1 to be provided with a return spring which makes it possible to urge the actuating wall(s) and therefore the reservoir into the rest position defining the maximum volume for the reservoir. The spring may be situated inside the reservoir 11, but it may also be situated outside, out of contact with the fluid contained in the reservoir 11. Preferably, prior to use, i.e. when the removable closure member 14 closes off the outlet orifice 13, the reservoir 11 contains a tiny quantity of fluid only, so that its volume is minimized or even almost zero. Since the removable closure member closes off the outlet orifice 13, air cannot penetrate into the reservoir, and the spring cannot relax. Therefore, it is compressed to its maximum extent so that it has a thickness that is very small, and preferably less than or equal to two millimeters. Conversely, as soon as the removable closure member 14 is removed, air penetrates into the reservoir via the outlet orifice 13, and the spring can relax to bring the reservoir to its maximum working volume. To obtain a jet of fluid, it is then necessary merely to depress the actuating wall(s) against the action of the spring so as to obtain a two-phase jet of air and of fluid. Such a dispenser is advantages in the dispenser assembly of the invention, but it should not be considered to be unique. However, it offers advantages related to its thinness prior to being used, and to its two-phase spray that is of very good quality.

The packaging 2 may be made from a single sheet of paper, of card, of plastic, of metal, or of a compound or laminate thereof. Therefore, the packaging 2 may be made in one piece.

The packaging 2 comprises a casing made up of two sheets 21 and 22, the sheet 21 constituting a backing or base sheet, and the sheet 22 constituting a cover sheet connected to the backing sheet 21 via a hinge and link line 212. The backing sheet 22 is thus hinged and can be folded over to be superposed on the backing sheet 21. The fluid dispenser 1 is disposed between the two sheets 21 and 22 which, once they are folded together, form a casing surrounding the dispenser 1. Each of the two sheets 21 and 22 is provided with a notch 211, 221 on the link line 212 so that, once they are folded together, the recesses 211 and 221 are mutually superposed so as to form a common notch that receives the outlet orifice 13, and more particularly its removable closure member 14, which is thus accessible so that it can be removed from the orifice 13. This is clearly visible in FIG. 2. In place of the notch 211, 221, it is also possible for the casing 21, 22 to form a tear-off portion covering the removable closure member 14. The dispenser 1 may advantageously be fixed by adhesion to one of the sheets, and preferably to the backing sheet 21 before folding the cover sheet 22 over onto the backing sheet 21. To close the casing, the cover sheet 22 may advantageously be bonded around its periphery to the backing sheet 21 by means of adhesive. The link line 212 then forms the top edge of the dispenser assembly, with its notch that receives the removable closure member 14 of the dispenser 1.

Since the dispenser 1 is particularly flat prior to being used, the casing is very thin so that it does not appear to contain anything. The thickness of the casing does not exceed three millimeters.

The packaging 2 also forms a flap made up of two sheets 23 and 24 connected together via a link and fold line 234. The flap is also connected to the casing 21, 22 via an interconnecting back 25 that connects the backing sheet 21 to the sheet 23 of the flap. The flap is thus hinged and can be folded over onto the casing by pivoting about the interconnecting back 25. The sheet 23 constitutes a base sheet while the sheet 24 constitutes a cover sheet that can be brought by pivoting about the line 234 so that it is superposed on the base sheet 23. The cover sheet 23 may be assembled to the base sheet 23 over their peripheries in the manner of the casing.

Once the two cover sheets 22 and 24 have been folded over and connected to their base sheets 21 and 23, the flap can be folded over onto the casing so that the cover sheet 24 comes into contact with the cover sheet 22. The dispenser assembly is then in the form of a small book with the base sheet 23 forming the front cover of the book, the cover sheets 24 and 22 forming the inside of the book, and the base sheet 21 forming the back cover of the book. The interconnecting back 25 connects the two sheets of the book together in the manner of a conventional book. The base sheet 23 of the hinged flap forms the outside face of the flap, while the cover sheet 24 forms the inside face of the flap. By adding a flap, it is possible to double the working area of the dispenser assembly that can be used to bear indications, and also makes it possible to mask and to protect the dispenser 1 as disposed in the casing. This is a very simple embodiment of the dispenser assembly of the invention.

In a more elaborate embodiment, the flap may be provided with an insert 3 forming a portion in relief 31 that projects from the outside face, i.e. from the base sheet 23 of the flap. A window 231 may be cut out in the base sheet 23, and the portion in relief 31 is received in said window 231 while projecting frontwards when the book is closed. Thus, only the portion in relief 31 is visible through the window 231, with the rear face of the insert 3 being completely masked by the cover sheet 24 that finishes off the hinged flap.

The portion in relief 31 of the insert 3 may, for example, be in the form of a bottle which may advantageously have the appearance of a genuine bottle of perfume that is on sale in the shops and a sample of which is made available by the dispenser 1. In reality, the portion in relief does not form a whole bottle of perfume. It forms merely the visible side face of the bottle of perfume. For example, the portion in relief may be in the form of one half of the bottle of perfume as cut in half on a vertical plane.

For example, the insert 3 may be made from a shell that is advantageously thermoformed and to which a closure film may be bonded, for example. The insert 3 thus forms a flat margin 32 and the portion in relief 31 is situated substantially centrally. Once it is disposed in the window 231, the cover sheet 24 can be folded over onto the base sheet 23 so that the flat margin 32 is held captive between the two sheets 23 and 24 and the portion in relief 31 is visible and projects through the window 231. It is thus not even necessary to fix the insert 3 between the two sheets 23 and 24.

Figure 2:
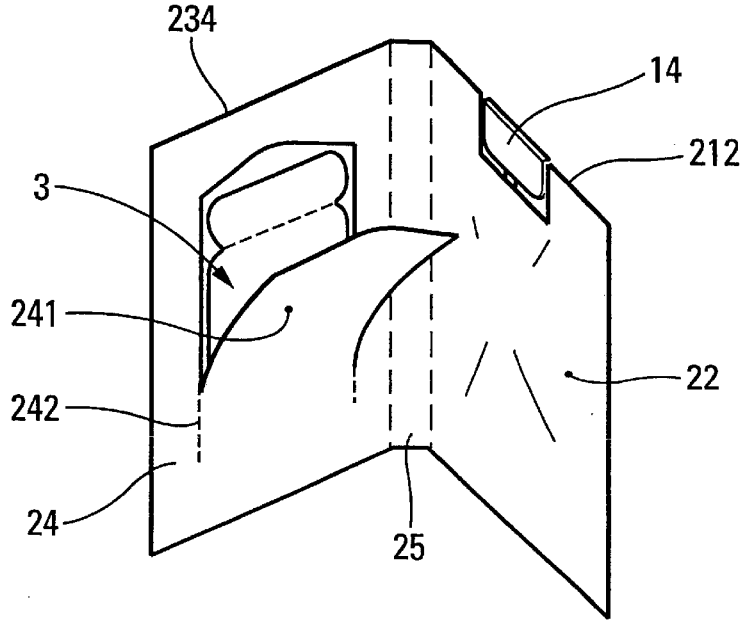
FIG. 2 is a view of the dispenser assembly of FIG. 1, shown in the assembled and open state.
Figure 3:
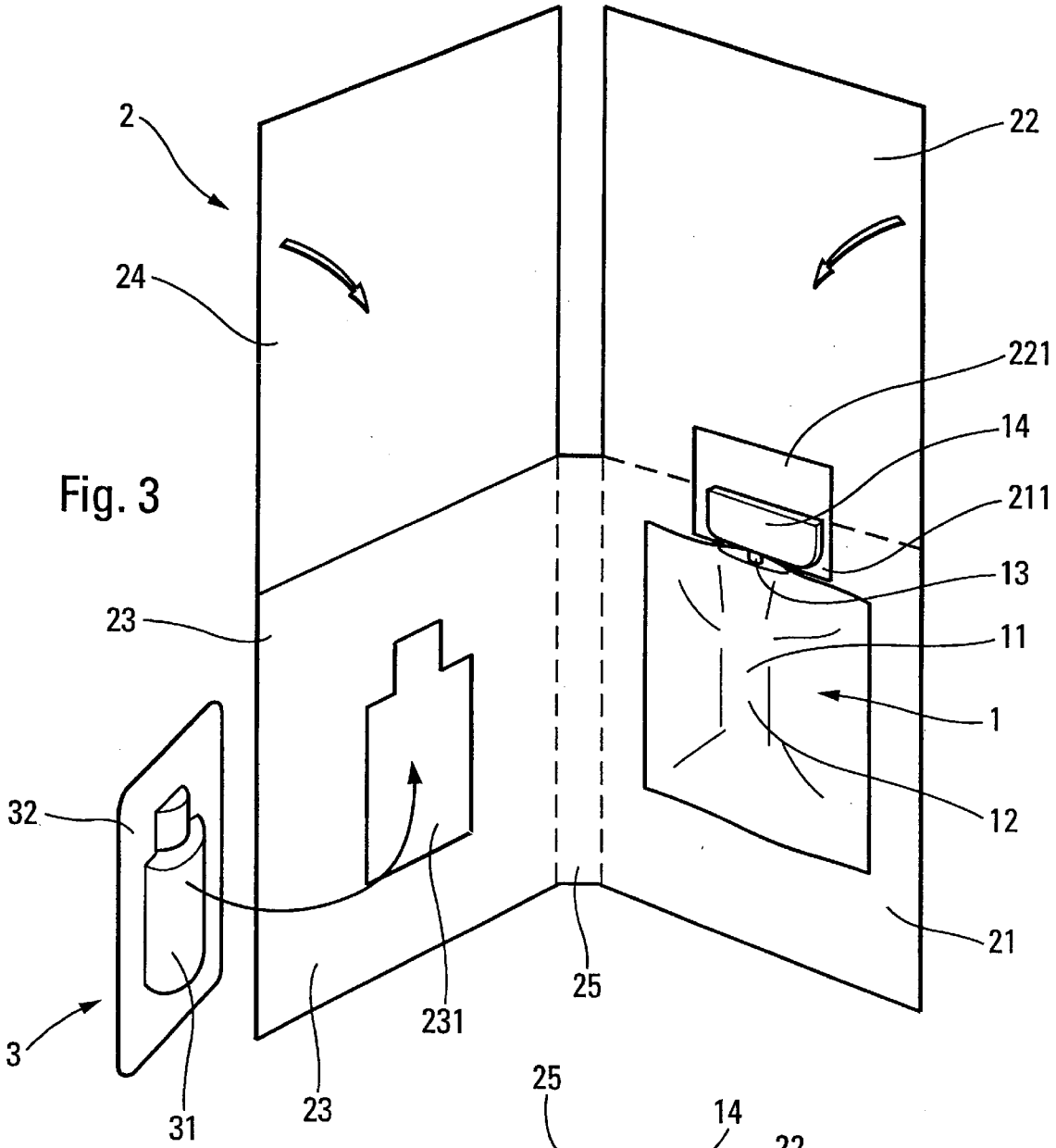
FIG. 3 is a view similar to the view of FIG. 1, showing a second embodiment of the invention.
Figure 4:
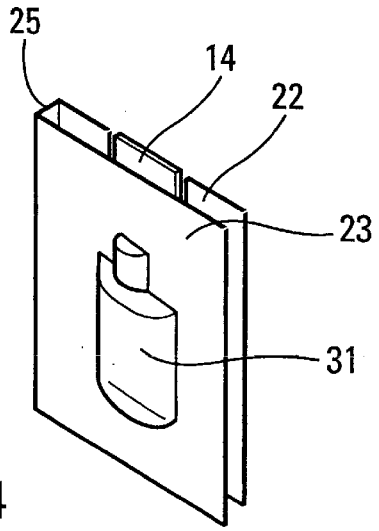
FIG. 4 is view similar to the view of FIG. 2, showing the embodiment of FIG. 3.

In a variant embodiment shown in FIGS. 1 and 2, the portion in relief 31 of the insert 3 may contain a fluid that can be identical to the fluid in the dispenser 1, but that may also be of some other type. The insert 3 is then in the form of a fluid container with its portion in relief 31 forming a reservoir. The insert 3 may also form a tear-off or fold-back tab 34 making it possible to form an opening on a line of least resistance 33. The fluid stored inside the portion in relief can then be extracted from the insert 3, e.g. by pushing in the portion in relief 31. The insert 3, which is disposed and held captive inside the flap, is advantageously accessible after a tear-off or peel-off portion 241 formed by the cover sheet 24 has been removed. This tear-off or peel-off portion 241 may be removed along a line of least resistance 242 as can be seen in FIG. 2. The insert 3 can then be removed from the flap so that it can be used.

It is to be noted that the outlet orifice 13 is located at an edge of the casing, namely at the upper edge adjacent the interconnecting back 25. Advantageously, the axis of the orifice extend in the plane of the dispenser and casing. Thus, the flap does not interfere with the spray at the exit of the orifice, even when the flap is folded over the casing. Therefore, it is possible to actuate the dispenser whereas the flap is located over the casing, simply in pushing on the insert. This is particularly advantageous, when the insert locks like the real dispenser from the market. The user may push on the insert and a spray is emitted. In this case, the dispenser is totally hidden.

By means of this hinged flap that can be folded over onto the casing, the indication-bearing area can be considerably increased, and the flap can also serve as a support for an aesthetically-pleasing representation of a bottle, or even more advantageously as a support for a promotional container of fluid.

What is claimed is:

1. A fluid dispenser assembly comprising:

a fluid dispenser (1) defining a fluid reservoir (11), a deformable actuating wall (12), and an outlet orifice (13); and packaging (2) defining a casing (21, 22) surrounding the dispenser (1), the actuating wall being pushed in via the casing;

said fluid dispenser assembly being characterized in that the packaging further comprises a hinged flap (23, 24) that can be folded over onto the casing (21, 22) so as to be superposed thereon, the flap being secured to or integral with the casing via a side edge (25), the flap comprising an outside face (23) and an inside face (24) serving to come into contact with the casing when the flap is folded over on the casing.

2. An assembly according to claim 1, in which the outside face (23) incorporates a portion in relief (31) defining an internal volume, said portion in relief projecting frontwards from the outside face.

3. An assembly according to claim 2, in which the portion in relief (31) is in the form of a bottle of perfume.

4. An assembly according to claim 2, in which the portion in relief (31) contains a fluid.

5. An assembly according to claim 4, in which the inside face (24) of the flap is provided with a peel-off or tear-off portion (241) forming an opening through which to access the back of the portion in relief (31).

6. An assembly according to claim 1, in which the outside face (23) of the flap is provided with a window (231) through which the portion in relief (31) projects.

7. An assembly according to claim 1, in which the portion in relief (31) is part of an insert (3) held between two sheets (23, 24) respectively forming the outside face (23) and the inside face (24) of the flap.

8. An assembly according to claim 1, in which the casing is made up of two sheets (21, 22) between which the dispenser (1) is disposed, the dispenser advantageously being fixed to one of the sheets.

9. An assembly according to claim 1, in which the flap and the casing are made in one piece.

10. An assembly according to claim 1, in which the dispenser (1) has a thickness less than or equal to 2 mm prior to being used.

* * * * *